US005412885A

United States Patent [19]

Cornelius

[11] Patent Number: 5,412,885

[45] Date of Patent: May 9, 1995

[54] BUCKET BASE EDGE PROTECTOR ASSEMBLY

[75] Inventor: Erwin D. Cornelius, Bloomington, Ill.

[73] Assignee: Caterpillar Inc., Peoria, Ill.

[21] Appl. No.: 85,372

[22] Filed: Jul. 2, 1993

[51] Int. Cl.[6] ..... E02F 3/36; A01B 15/00

[52] U.S. Cl. ..... 37/451; 37/446; 37/450; 37/453; 37/455; 172/719; 172/772; 172/772.5

[58] Field of Search ..... 37/446, 450, 451, 453, 37/455; 172/719, 772, 772.5

[56] References Cited

U.S. PATENT DOCUMENTS

| | | | |
|---|---|---|---|
| 1,796,737 | 3/1931 | Van Buskirk . | |
| 3,508,352 | 4/1970 | Radwill | 37/455 |
| 3,621,594 | 11/1971 | Hahn et al. | 37/141 |
| 3,736,664 | 6/1973 | Black et al. | 37/141 |
| 3,762,079 | 10/1973 | Lukavich et al. | 37/141 |
| 3,995,384 | 12/1976 | Wood | 172/719 |
| 4,006,544 | 2/1977 | Stepe | 37/141 |
| 4,238,896 | 12/1980 | Lanz et al. | 37/141 |
| 5,016,365 | 5/1991 | Robinson | 37/141 |
| 5,088,214 | 2/1992 | Jones | 37/450 |

*Primary Examiner*—Randolph A. Reese

*Assistant Examiner*—Andrea Chop

*Attorney, Agent, or Firm*—O. Gordon Pence

[57] ABSTRACT

Edge protectors for the leading portions of base edges have been utilized in many application to protect the leading portion of the base edge. It is advantageous to have an edge protector that is readily removed and replaced without having to remove additional elements. In the subject arrangement, a base edge protector assembly is included having a protector mounting lug and a replaceable lip protector. The protector mounting lug has a pair of spaced apart bosses and a laterally disposed flange therebetween while the lip protector has a cavity and load transferring surfaces located in the cavity. When assembled the load transferring surfaces are in mating contact with the laterally disposed flange of the protector mounting lug. First and second pairs of aligned openings are located in the lip protector and, when assembled, are in general alignment with the openings located in each boss of the pair of bosses. Flex pins are disposed in the openings to secure the lip protector to the protector mounting lug. This arrangement provides a lip protector that is easily removed and replaced without the need to remove any other elements.

7 Claims, 2 Drawing Sheets

BUCKET BASE EDGE PROTECTOR ASSEMBLY

TECHNICAL FIELD

This invention relates generally to a bucket base edge assembly and more particularly to a protector assembly for a bucket base edge.

BACKGROUND ART

There have been arrangements used in the past to protect the forward edge of a bucket's base edge. In some applications, a wear resistant member is welded to the leading edge between respective tip assemblies to increase the life thereof. In other arrangements, individual members have been bolted to the base edge between the respective tip assemblies.

In various other arrangements, the base edge protector has been secured between respective tip assemblies and fastened directly to the tip assemblies by various forms of fasteners and/or are held in position by a mechanical interlock once the tip is mounted on and secured to the adapter. In these arrangements, it is necessary to remove the tip before the base edge protector can be removed.

In most of the above-noted arrangements, the base edge of the bucket is formed from a heavy flat steel plate and the tip assemblies are either welded to the base edge plate or pinned thereto by various types of fasteners. Likewise, as noted above, in some of the arrangements, the edge protector is either welded to the bucket's base edge plate or pinned thereto. Consequently, it is advantageous to provide an arrangement in which the base edge protector is readily secured to the plate of the bucket base edge while allowing serviceability of the base edge protector without any interference with the respective tip assemblies located on either side of the base edge protector.

The present invention is directed to overcoming one or more of the problems as set forth above.

DISCLOSURE OF THE INVENTION

In one aspect of the present invention, a bucket base edge protector assembly is provided and adapted for protecting the leading lip portion of a bucket base edge and is located between respective tip assemblies. The bucket base edge protector assembly includes a lip protector, a protector mounting lug and a retainer mechanism. The lip protector has a leading portion operative to engage the material being worked and a trailing portion having an upper strap and a lower strap defining a cavity therebetween. First and second spaced apart pairs of aligned openings are defined in the trailing portion in intersecting relation with the cavity. The protector mounting lug has a forward portion operative to mate with the cavity in the lip protector and a rearward portion adapted, when assembled, to be secured to the leading lip portion of the bucket base edge. The forward portion of the protector mounting lug has a pair of spaced apart bosses separated by a laterally disposed flange and defines an opening in each boss of the pair of bosses. The retainer mechanism is operative to releasably secure the lip protector to the protector mounting lug.

In another aspect of the present invention, a lip protector is provided and adapted in use to be mounted on a protector mounting lug for protecting the leading lip portion of a bucket base edge located between respective tip assemblies. The lip protector includes a leading portion operative in use to engage the material being worked and a trailing portion adapted for connection to the protector mounting lug. The trailing portion has an upper strap and a lower strap defining a cavity therebetween. First and second pairs of aligned openings are defined in the trailing portion in intersecting relation with the cavity. A laterally disposed load transferring bottom surface is located at the bottom of the cavity and centrally disposed along a portion thereof.

The present invention provides a bucket base edge protector assembly that is readily secured to the leading lip portion of a bucket base edge in a location between respective tip assemblies. In this arrangement, the lip protector is easily assembled or disassembled without having to remove or disturb elements of the respective tip assemblies.

BEST MODE FOR CARRYING OUT THE INVENTION

Figure 1:
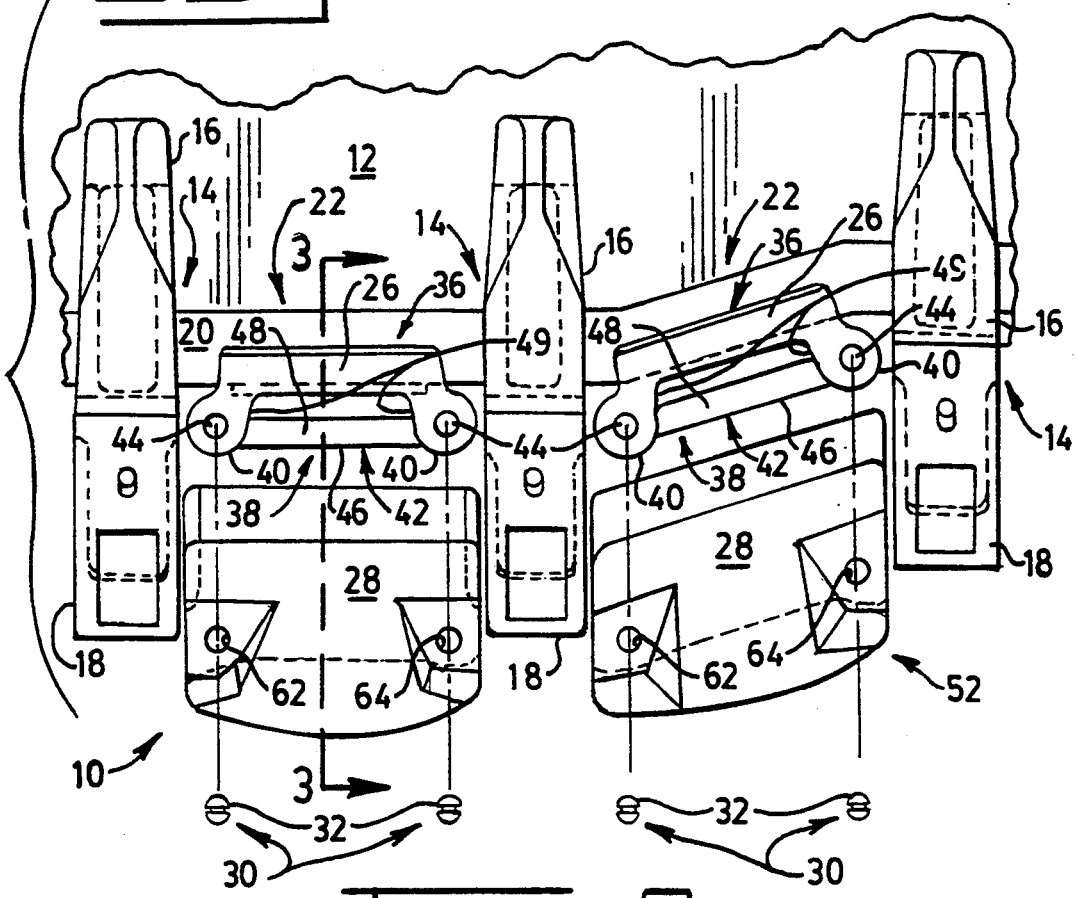
FIG. 1 is a top plan view of a portion of a bucket base edge illustrating the elements of the subject embodiment in their unassembled condition.
Figure 2:
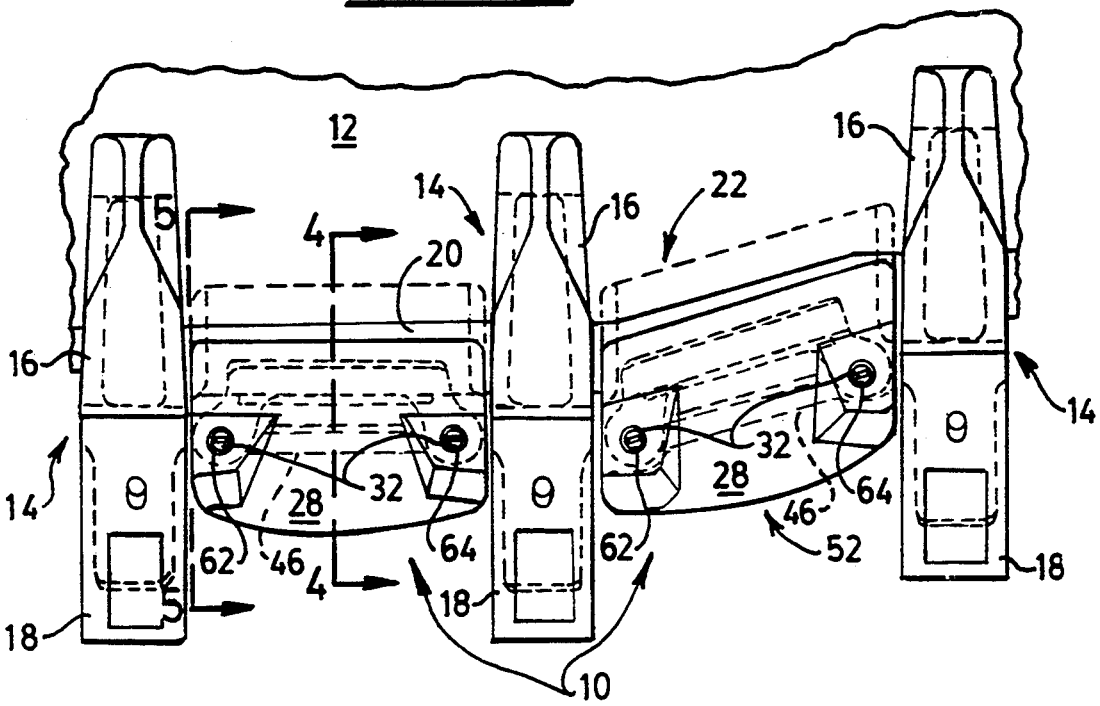
FIG. 2 is a top plan view of the portion of the bucket base edge of FIG. 1 illustrating the elements of the subject embodiment in their assembled position.

Referring to the drawings, a pair of base edge protector assemblies 10 are shown connected to a portion of a base edge 12 of a bucket (not shown) and being located between respective tip assemblies 14. The tip assemblies 14 are composed of an adapter 16 welded to the portion of the base edge 12 and a tooth 18 releasably mounted thereon. It is recognized that the adapter 16 could be releasably secured to the portion of the base edge 12 in any well-known manner.

The portion of the base edge 12, as illustrated, is made from a standard rolled plate having a beveled surface 20 located on a leading lip portion 22 thereof. It is recognized that the leading lip portion 22 could have an end surface that is totally flat as opposed to the beveled surface 20. The need for a beveled surface 20 on the portion of the base edge 12 is normally dependent on the required thickness of the base edge 12. The base edge protector assembly 10 includes a protector mounting lug 26 secured to the portion of the base edge 12, a lip protector 28 operatively mounted on the protector mounting lug 26 and a retainer mechanism 30 operative to secure the lip protector 28 to the protector mounting lug 26.

The retainer mechanism 30 includes a pair of well-known flex pins 32. It is recognized that various types of retainer mechanisms 30 could be utilized without departing from the essence of the invention.

The protector mounting lug 26 has a rearward portion 36 that is operative to secure the protector mounting lug 26 to the portion of the base edge 12. In the subject embodiment, the protector mounting lug 26 is welded to the portion of the base edge 12. The protector mounting lug 26 has a forward portion 38 operative to mount the lip protector 28 thereto. The forward portion 38 also has a pair of spaced apart bosses 40 having a laterally disposed flange 42 disposed therebetween. An opening 44 is defined in each boss of the pair of bosses 40.

The laterally disposed flange 42 has a generally flat load transferring end surface 46 and a generally flat load transferring top surface 48. The generally flat load transferring top surface 48 is located adjacent to and perpendicular with the generally flat load transferring end surface 46. A generally flat upright load transferring side surface 49 is located on each boss of the pair of bosses 40 adjacent the ends of the generally flat load transferring top surface 48.

The lip protector 28 has a leading portion 52 operative to engage the material being worked and a trailing portion 54 operative to mount the lip protector 28 to the protector mounting lug 26. The trailing portion 54 has an upper strap 56, a lower strap 58 and a cavity 60 defined therebetween. The cavity 60 includes enlarged portions 61 operative to receive, when assembled with the protector mounting lug 26, the respective ones of the pair of bosses 40. When assembled, the respective upright load transferring side surfaces 49 of the bosses 40 are in mating contact with respective upright surface portions of the lip protector 28 inside the enlarged portions 61.

First and second pairs of aligned openings 62,64 are defined in the lip protector 28 in intersecting relation with the enlarged portions 61 of the cavity 60. The first and second pairs of aligned openings 62,64 are laterally spaced from one another.

The lip protector 28 includes a load transferring bottom surface 66 laterally disposed at the bottom of the cavity 60. A laterally disposed load transferring inner surface 68 is located on the upper strap 56 inside the cavity 60 generally between the enlarged portions 61 thereof. The laterally disposed load transferring inner surface 68 is located adjacent to and perpendicular with the laterally disposed load transferring bottom surface 66.

It is recognized that various forms of the base edge protector assembly 10 could be utilized without departing from the essence of the invention. For example, as illustrated the respective lip protectors 28 may be oriented for mounting on the protector mounting lug 26 transverse with the direction of travel or it may be altered so that it is mounted on the protector mounting lug 26 oriented at an angle with respect to the direction of travel. Consequently, since the base edge 12 has a laterally stepped leading lip portion 22, the angled lip protector 28 illustrated herein is made to fit on the right side of the bucket. Likewise a lip protector 28 can be made to fit on the left side of the bucket without departing from the essence of the invention. It is further recognized that the leading lip portion 22 of the base edge 12 could be straight as opposed to being stepped. The cavity 60 of the lip protector 28 in either of the arrangements is generally the same.

INDUSTRIAL APPLICABILITY

Figure 3:
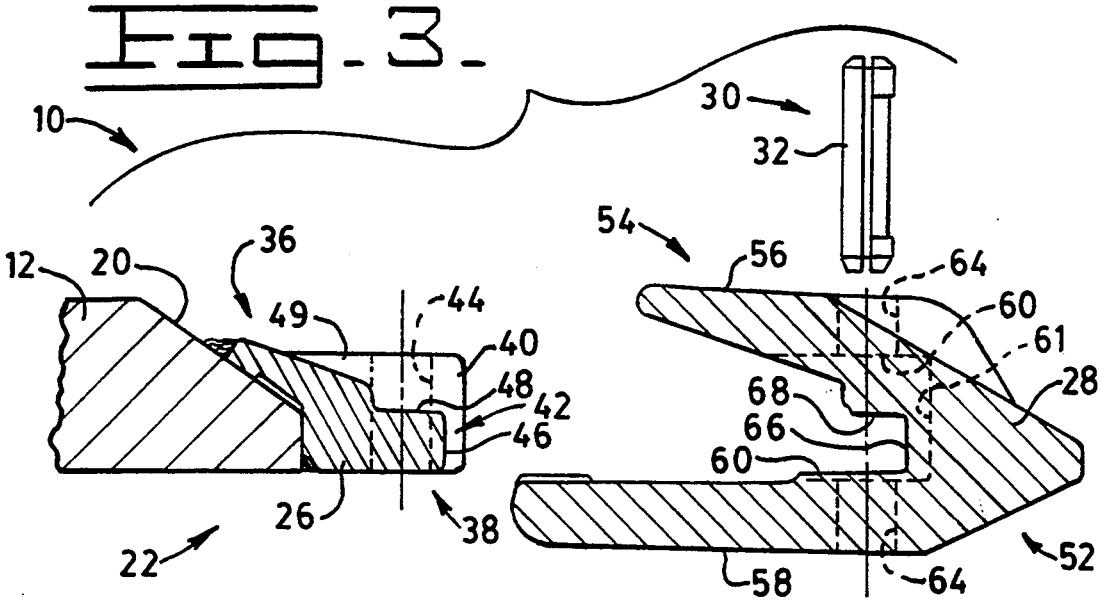
FIG. 3 is a partial section view taken along a line 3—3 of FIG. 1.
Figure 4:
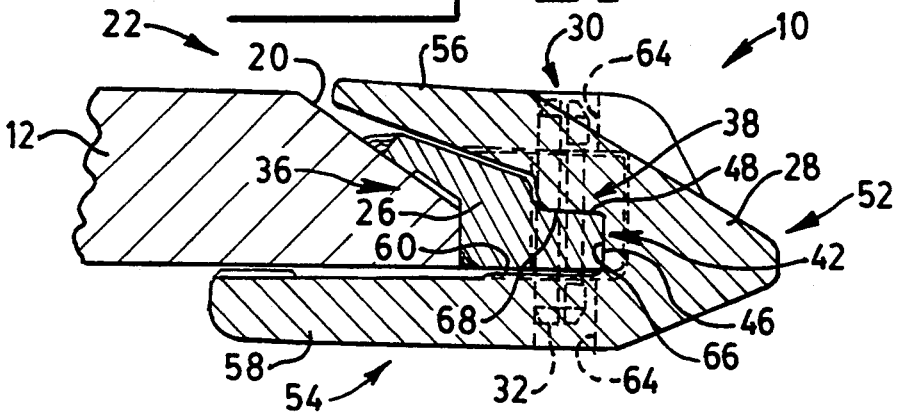
FIG. 4 is a partial section view taken along a line 4—4 of FIG. 2.
Figure 5:
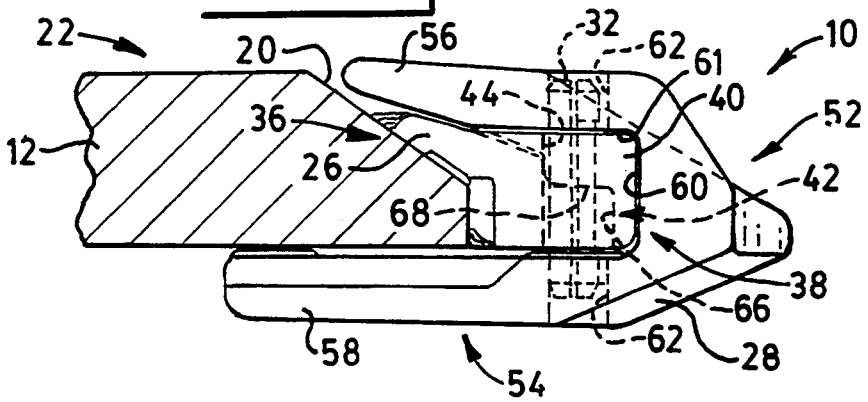
FIG. 5 is a partial section and side elevational view taken along 5—5 of FIG. 2.

In the operation of the base edge protector assembly 10, the protector mounting lug 26 is welded to the base edge 12 as clearly illustrated in FIG. 3. The lip protector 28 is slipped over the protector mounting lug 26 so that the protector mounting lug 26 is received in the cavity 60 in mating relationship therewith. Following mounting the lip protector 28 on the protector mounting lug 26, the flex pin 32 is inserted through the first pair of aligned openings 62 and the opening 44 of the protector mounting lug 26. Another flex pin 32 is likewise inserted through the second pair of aligned openings 64 and the other opening 44 in the protector mounting lug 26. The flex pins 32 are operative to releasably secure the lip protector 28 to the protector mounting lug 26.

In use, the forces directed to the leading portion 52 of the lip protector 28 is transferred from the load transferring bottom surface 66 in the lip protector 28 to the load transferring end surface 46 of the protector mounting lug 26. Downward forces are transferred from the load transferring inner surface 68 of the lip protector 28 to the load transferring top surface 48 of the protector mounting lug 26. Likewise, any tendency of the lip protector 28 to pivot about the load transferring top surface 48 is inhibited by the lower strap 58 contacting the bottom of the protector mounting lug 26 and/or the bottom of the base portion 12. Any upward forces directed to the leading portion 52 of the lip protector 28 are transferred from the lower strap 58 of the lip protector to the protector mounting lug 26 and/or the bottom of the base portion 12. Any pivoting of the lip protector 28 about the end of the protector mounting lug 26 is inhibited by the upper strap 56.

Since the load transferring inner surface 68 of the lip protector 28 is located between the enlarged portions 61, any tendency of the lip protector 28 to move laterally is inhibited by corresponding portions of the lip protector 28 engaging the upright surfaces 49 of the protector mounting lug 26. Consequently, all lateral forces are directed from the lip protector 28 directly to the mounting lug protector 26, thus, generally eliminating any large lateral forces being exerted on the flex pins 32.

In view of the foregoing, it is readily apparent that the structure of the present invention provides a base edge protector assembly 10 wherein the lip protector 28 thereof can readily be removed and replaced without having to remove any of the tips 18 from their respective adapters 16. Likewise, the tips 18 are readily removed and replaced without having to remove any of the lip protectors 28. Consequently, this structure provides a simple arrangement that can readily be serviced without requiring removing of additional parts.

Other aspects, objects, and advantages of this invention can be obtained through a study of the drawings, the disclosure, and the appended claims.

The invention claimed is:

1. A bucket base edge protector assembly adapted for protecting a leading lip portion of a bucket base edge located between respective tip assemblies comprising:

a lip protector having a leading portion operative to engage the material being worked and a trailing portion having an upper strap and a lower strap defining a cavity therebetween, first and second spaced apart pairs of aligned openings are defined in the trailing portion in intersecting relation with the cavity;

a protector mounting lug having a forward portion operative to mate with the cavity in the lip protector and a rearward portion being adapted, when assembled, to be secured to the leading lip portion of the bucket, the forward portion having a pair of spaced apart bosses separated by a laterally disposed flange and an opening being defined in each boss of the pair of bosses; and a retainer mechanism operative to releasably secure the lip protector to the protector mounting lug.

2. The bucket base edge protector of claim 1 wherein the laterally disposed flange has a generally flat laterally disposed load transferring end surface and a generally flat laterally disposed load transferring top surface.

3. The bucket base edge protector of claim 2 wherein the load transferring top surface is located generally adjacent to and perpendicular with the load transferring end surface.

4. The bucket base edge protector of claim 3 wherein the lip protector has a laterally disposed load transferring bottom surface in a portion of the cavity operative to contact the laterally disposed load transferring end surface of the protector mounting lug.

5. The bucket base edge protector of claim 4 wherein the cavity has an enlarged portion located at each end thereof and the lip protector has a laterally disposed load transferring inner surface located on the upper strap between the enlarged portions thereof and operative to contact the laterally disposed load transferring top surface of the protector mounting lug.

6. The bucket base edge protector of claim 5 wherein a load transferring upright surface is disposed on each of the bosses adjacent the ends of the laterally disposed load transferring top surface and in operative mating contact with respective portion of the lip protector inside the enlarged portions of the cavity to transfer lateral forces from the lip protector to the protector mounting lug.

7. A lip protector adapted in use to be mounted on a protector mounting lug for protecting a leading lip portion of a bucket base edge between respective tip assemblies, comprising:

a leading portion operative, in use, to engage the material being worked;

a trailing portion adapted for connection to the protector mounting lug, the trailing portion having an upper strap and a lower strap defining a cavity therebetween;

said cavity having a central cavity portion and a pair of enlarged end cavity portions, said central cavity portion having a laterally disposed load transferring bottom surface located at the bottom of said central cavity portion and a laterally disposed load transferring inner surface disposed generally adjacent and generally perpendicular to the load transferring bottom surface;

first and second pairs of aligned openings, each pair being defined through the upper strap and the lower strap of said trailing portion and located through a respective one of said enlarged end cavity portions; and each of said enlarged end cavity portions having an upper surface and an upright side surface, each upper surface being elevated above and parallel to the inner surface of the central cavity portion, and the upright side surface of each end cavity portion extending between its elevated upper surface and said inner surface of said central cavity portion, each of said upright side surfaces being disposed generally perpendicular to the inner surface of said central cavity portion, and being operative, in use, as a lateral load transferring surface for directing lateral forces from the lip protector to the protector mounting lug.

* * * * *